US008948660B2

(12) United States Patent
Baker et al.

(10) Patent No.: US 8,948,660 B2
(45) Date of Patent: Feb. 3, 2015

(54) TONER CARTRIDGE HAVING ENGAGEMENT FEATURES TO ACTUATE A DEVELOPER UNIT SHUTTER

(75) Inventors: Ronald Willard Baker, Versailles, KY (US); Stephen Andrew Brown, Lyndhurst, OH (US); Michael Craig Leemhuis, Nicholasville, KY (US); David Lee Merrifield, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 383 days.

(21) Appl. No.: 13/459,313

(22) Filed: Apr. 30, 2012

(65) Prior Publication Data

US 2013/0287448 A1 Oct. 31, 2013

(51) Int. Cl.
*G03G 15/08* (2006.01)

(52) U.S. Cl.
USPC ..... 399/258; 399/262

(58) Field of Classification Search
CPC ..... G03G 15/0839; G03G 15/0875; G03G 15/0886; G03G 2215/066; G03G 2215/068; G03G 2215/0692; B65D 47/28; B65D 47/286; B65D 2585/6892
USPC ..... 399/258, 260, 262; 222/453, 502, 503, 222/559, DIG. 1
See application file for complete search history.

(56) References Cited

U.S. PATENT DOCUMENTS 5,686,985 A * 11/1997 Hayashi ..... 399/222
5,689,773 A 11/1997 Ha
5,842,093 A * 11/1998 Tanda ..... 399/263
6,115,571 A 9/2000 Kobayashi
7,548,710 B2 6/2009 Gayne et al.
7,574,163 B2 * 8/2009 Sato ..... 399/260
7,606,520 B2 10/2009 Dawson
7,647,005 B2 1/2010 Takagi
7,734,197 B2 6/2010 Sato (Continued)

FOREIGN PATENT DOCUMENTS

JP 04070779 A * 3/1992
JP 2002268356 A * 9/2002
JP 2011191618 A * 9/2011

OTHER PUBLICATIONS

International Search Report and Written Opinion of the International Search Authority dated Sep. 4, 2013 for PCT Application No. PCT/US13/38342.

(Continued)

*Primary Examiner* — Robert Beatty
(74) *Attorney, Agent, or Firm* — Justin M Tromp

(57) ABSTRACT

A toner cartridge according to one example embodiment includes a housing having a reservoir for holding toner. An outlet port is positioned on the front of the housing for transferring toner from the reservoir to the developer unit through an inlet port on the developer unit. A first engagement member projecting from the front of the housing is positioned to provide an initial force to begin to open a shutter on the inlet port of the developer unit as the toner cartridge is inserted in the image forming device. A second engagement member projecting from the front of the housing is spaced toward one of the sides of the housing from the first engagement member and positioned to provide a force to continue to open the shutter on the inlet port of the developer unit as the toner cartridge is inserted further in the image forming device.

20 Claims, 14 Drawing Sheets

(56) References Cited

U.S. PATENT DOCUMENTS

| | | | | |
|---|---|---|---|---|
| 8,160,481 | B2 * | 4/2012 | Kitagawa et al. | 399/258 |
| 8,644,738 | B2 * | 2/2014 | Takashima | 399/258 |
| 2005/0271425 | A1 | 12/2005 | Shimomura et al. | |
| 2006/0083555 | A1 | 4/2006 | Uchiyama et al. | |
| 2008/0101821 | A1 | 5/2008 | Gayne et al. | |
| 2008/0317510 | A1 | 12/2008 | Choi et al. | |
| 2009/0010679 | A1 | 1/2009 | Shimomura et al. | |
| 2009/0016779 | A1 | 1/2009 | Hwang | |
| 2009/0142103 | A1 | 6/2009 | Chaudhuri et al. | |
| 2009/0232547 | A1 | 9/2009 | Nagae et al. | |
| 2010/0322676 | A1 * | 12/2010 | Dawson et al. | 399/262 |
| 2012/0219328 | A1 * | 8/2012 | Oda et al. | 399/260 |

OTHER PUBLICATIONS

U.S. Appl. No. 13/458,249, filed Apr. 27, 2012 entitled "Shutter Assembly for a Toner Cantainer".

U.S. Appl. No. 13/420,956, filed Mar. 15, 2012 entitled "Movable Toner Port Cover Member for a Replaceable Unit of an Imaging Device".

U.S. Appl. No. 13/459,306, filed Apr. 30, 2012 entitled "Shutter for a Developer Unit for Use With an Image Forming Device".

On or around Feb. 18, 2011, Lexmark International, Inc. ("Lexmark"), assignee of the present application, obtained a quote from an outside vendor for the preparation of tooling to construct a main housing portion, which is depicted in the attached Figures 1-5, of a toner cartridge from molded plastic. Communications and documents exchanged between Lexmark and the vendor were subject to a confidentiality agreement executed by the parties. On or around Apr. 22, 2011, Lexmark ordered from the vendor a limited number of prototypes of the main housing portion to be constructed using the quoted mold tooling. On or around May 6, 2011, Lexmark received the prototypes of the main housing portion from the vendor. At the inventors' direction, the prototypes of the main housing portion were then assembled with other components to form prototypes of a completed toner cartridge to be used by the inventors for experimentation. The toner cartridge prototypes were then tested at the inventors' direction and under the inventors' control to evaluate their performance. After testing the prototypes, the inventors determined that the toner cartridges utilizing the main housing portion substantially depicted in the attached Figures 1-5 did not function as intended. As a result, modifications to the design of the main housing portion were made by the inventors resulting in the modified main housing portion 112 and toner cartridge 100 substantially as shown in Figures 7-14B of the present application.

* cited by examiner

TONER CARTRIDGE HAVING ENGAGEMENT FEATURES TO ACTUATE A DEVELOPER UNIT SHUTTER

CROSS REFERENCES TO RELATED APPLICATIONS

This application is related to U.S. patent application Ser. No. 13/459,306, filed Apr. 30, 2012, entitled "Shutter for a Developer Unit for Use with an Image Forming Device", which is assigned to the same assignee as the present application.

BACKGROUND

1. Field of the Disclosure

The present invention relates generally to electrophotographic printers and more particularly to a shutter for a developer unit and a toner cartridge having engagement features to actuate the shutter.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components such as a developer roll, a toner adder roll and a doctor blade are positioned in one replaceable unit (a "developer unit"). The image forming device's toner supply, which is consumed relatively quickly in comparison with the components housed in the developer unit, is provided in a reservoir in a separate replaceable unit in the form of a toner cartridge that mates with the developer unit. In this configuration, the number of components housed in the toner cartridge is reduced in comparison with traditional toner cartridges.

Image forming devices having a separate toner cartridge and developer unit are susceptible to leakage of toner between an outlet port of the toner cartridge and an inlet port of the developer unit. Toner leakage is most frequently experienced when the toner cartridge is separated from the developer unit and removed from the image forming device. When this occurs, handling, moving or shipping of the image forming device may cause toner to escape from the inlet port of the developer unit. Leaked toner may contaminate both internal and external surfaces of the image forming device resulting in not only uncleanliness but, in some cases, reliability issues or print defects. Accordingly, a developer unit having a shutter for ensuring that toner does not escape the developer unit when the toner cartridge is removed is desired.

Providing such a shutter presents several challenges. First, the developer unit must be precisely positioned relative to its corresponding photoconductive drum. Otherwise, print defects may occur such as "white gapping" where the developer roll momentarily separates from the photoconductive drum and fails to supply toner to the drum. Accordingly, the force balance on the developer unit must be tightly controlled. Second, the timing of the opening and closing of a shutter on the inlet port of the developer unit must be precise relative to the insertion or removal of the toner cartridge and the opening and closing of a corresponding shutter on the outlet port of the toner cartridge. Third, both the shutter on the outlet port of the toner cartridge and the shutter on the inlet port of the developer unit must open and close reliably upon cartridge insertion and removal over the life of the components and throughout a range of part tolerances and cartridge insertion paths.

SUMMARY

A toner cartridge for use with a developer unit of an image forming device according to one example embodiment includes a housing having a front, a rear, a top, a bottom and a pair of sides. The housing also has a reservoir for holding toner. An outlet port is positioned on the front of the housing for transferring toner from the reservoir to the developer unit through an inlet port on the developer unit. A first engagement member projecting from the front of the housing is positioned to provide an initial force to begin to open a shutter on the inlet port of the developer unit as the toner cartridge is inserted in the image forming device. A second engagement member projecting from the front of the housing is spaced toward one of the sides of the housing from the first engagement member and positioned to provide a force to continue to open the shutter on the inlet port of the developer unit as the toner cartridge is inserted further in the image forming device.

A toner cartridge for use with a developer unit of an image forming device according to another example embodiment includes a housing having a front, a rear, a top, a bottom and a pair of sides. The housing also has a reservoir for holding toner. An outlet port is positioned on the front of the housing for transferring toner from the reservoir to the developer unit through an inlet port on the developer unit. A first engagement member projects from the front of the housing. The first engagement member has a first leading ramped front surface that projects further forward as it travels up the front of the toner cartridge. The first ramped front surface leads to a first vertical front surface positioned above the first ramped front surface. A second engagement member projects from the front of the housing and is spaced toward one of the sides of the housing from the first engagement member. The second engagement member has a second leading ramped front surface that projects further forward as it travels up the front of the toner cartridge. The second ramped front surface leads to a second vertical front surface positioned above the second ramped front surface. The second vertical front surface and at least a portion of the second ramped front surface project further forward than the first vertical front surface. An alignment member is positioned on the front of the housing that has a first ramped side surface that projects further toward one of the sides of the housing as the first ramped side surface travels up the front of the housing. The first ramped side surface leads to a second ramped side surface positioned above the first ramped side surface. The projection of the second ramped side surface toward the side of the housing decreases as the second ramped side surface travels up the front of the housing.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
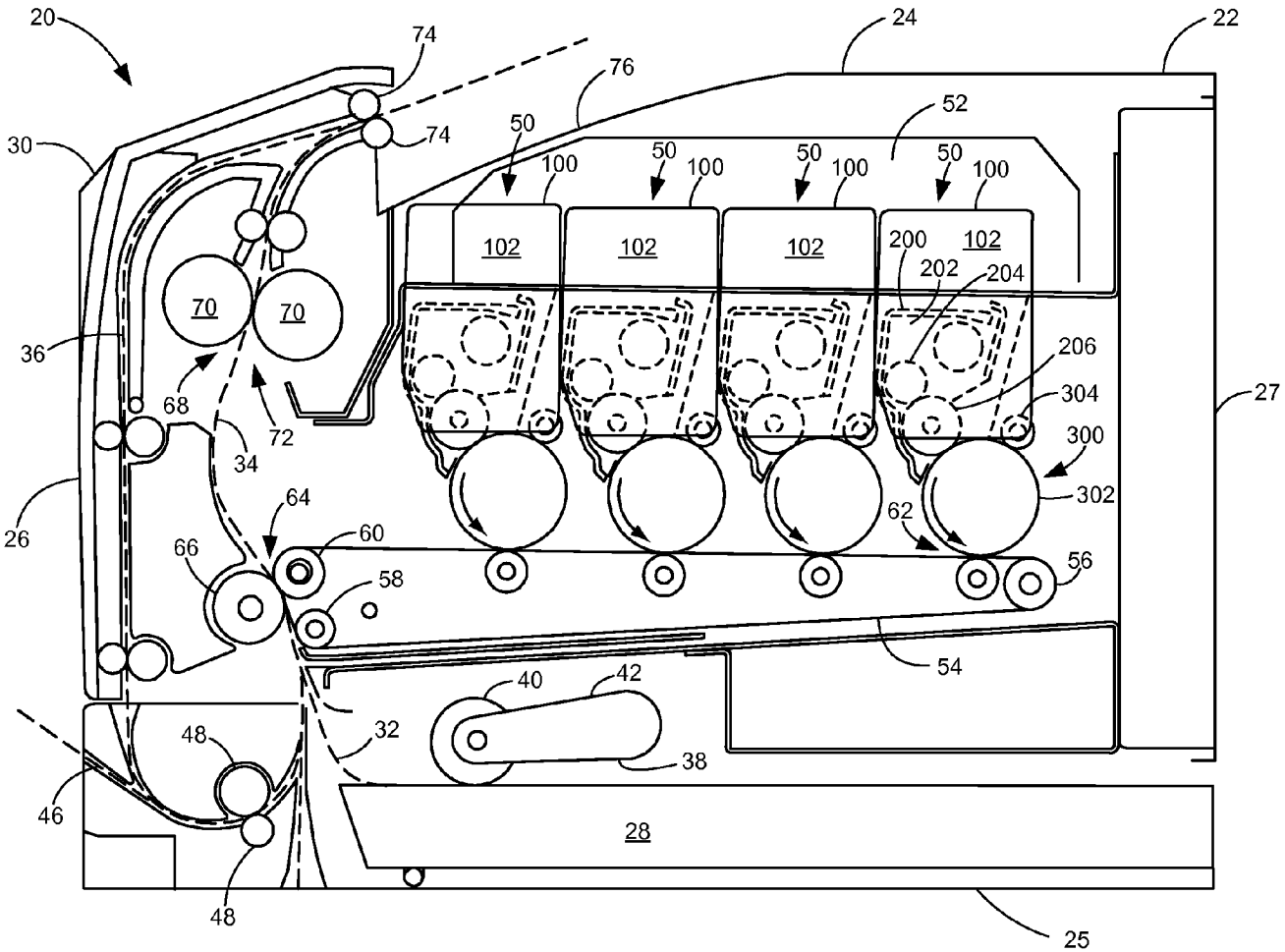
FIG. 1 is a schematic side view of the interior of an image forming device according to one example embodiment.

FIG. 1 illustrates a schematic view of the interior of an example image forming device 20. Image forming device 20 includes a housing 22 having a top 24, bottom 25, front 26 and rear 27. Housing 22 includes one or more input trays 28 positioned therein. Trays 28 are sized to contain a stack of media sheets. As used herein, the term media is meant to encompass not only paper but also labels, envelopes, fabrics, photographic paper or any other desired substrate. Trays 28 are preferably removable for refilling. A control panel 30 may be located on housing 22. Using control panel 30, the user is able to enter commands and generally control the operation of the image forming device 20. For example, the user may enter commands to switch modes (e.g., color mode, monochrome mode), view the number of images printed, etc. A media path 32 extends through image forming device 20 for moving the media sheets through the image transfer process. Media path 32 includes a simplex path 34 and may include a duplex path 36. A media sheet is introduced into simplex path 34 from tray 28 by a pick mechanism 38. In the example embodiment shown, pick mechanism 38 includes a roll 40 positioned at the end of a pivotable arm 42. Roll 40 rotates to move the media sheet from tray 28 and into media path 32. The media sheet is then moved along media path 32 by various transport rollers. Media sheets may also be introduced into media path 32 by a manual feed 46 having one or more rolls 48.

Image forming device 20 includes an image transfer section that includes one or more imaging stations 50. Each imaging station 50 includes a cartridge 100 and a developer unit 200 mounted on a common photoconductive unit 300. Each toner cartridge 100 includes a reservoir 102 for holding toner and an outlet port in communication with an inlet port of a corresponding developer unit 200 for transferring toner from reservoir 102 to developer unit 200 as discussed in greater detail below. One or more agitating members may be positioned within reservoir 102 to aid in moving the toner. Each developer unit 200 includes a toner reservoir 202 and a toner adder roll 204 that moves toner from reservoir 202 to a developer roll 206. The photoconductive unit 300 includes a charging roll 304 and a photoconductive (PC) drum 302 for each imaging station 50. PC drums 302 are mounted substantially parallel to each other. For purposes of clarity, developer unit 200, PC drum 302 and charging roll 304 are labeled on only one of the imaging stations 50. In the example embodiment illustrated, each imaging station 50 is substantially the same except for the color of toner.

Each charging roll 304 forms a nip with the corresponding PC drum 302. During a print operation, charging roll 304 charges the surface of PC drum 302 to a specified voltage such as, for example, −1000 volts. A laser beam from a printhead 52 associated with each imaging station 50 is then directed to the surface of PC drum 302 and selectively discharges those areas it contacts to form a latent image. In one embodiment, areas on PC drum 302 illuminated by the laser beam are discharged to approximately −300 volts. Developer roll 206, which forms a nip with the corresponding PC drum 302, then transfers toner to PC drum 302 to form a toner image. A metering device such as a doctor blade assembly can be used to meter toner onto developer roll 206 and apply a desired charge on the toner prior to its transfer to PC drum 302. The toner is attracted to the areas of PC drum 302 surface discharged by the laser beam from the printhead 52.

An intermediate transfer mechanism (ITM) 54 is disposed adjacent to the imaging stations 50. In this embodiment, ITM 54 is formed as an endless belt trained about a drive roll 56, a tension roll 58 and a back-up roll 60. During image forming operations, ITM 54 moves past imaging stations 50 in a clockwise direction as viewed in FIG. 1. One or more of PC drums 302 apply toner images in their respective colors to ITM 54 at a first transfer nip 62. In one embodiment, a positive voltage field attracts the toner image from PC drums 302 to the surface of the moving ITM 54. ITM 54 rotates and collects the one or more toner images from imaging stations 50 and then conveys the toner images to a media sheet at a second transfer nip 64 formed between a transfer roll 66 and ITM 54, which is supported by back-up roll 60.

A media sheet advancing through simplex path 34 receives the toner image from ITM 54 as it moves through the second transfer nip 64. The media sheet with the toner image is then moved along the media path 32 and into a fuser area 68. Fuser area 68 includes fusing rolls or belts 70 that form a nip 72 to adhere the toner image to the media sheet. The fused media sheet then passes through exit rolls 74 that are located downstream from the fuser area 68. Exit rolls 74 may be rotated in either forward or reverse directions. In a forward direction, the exit rolls 74 move the media sheet from simplex path 34 to an output area 76 on top 24 of image forming device 20. In a reverse direction, exit rolls 74 move the media sheet into duplex path 36 for image formation on a second side of the media sheet.

Figure 2:
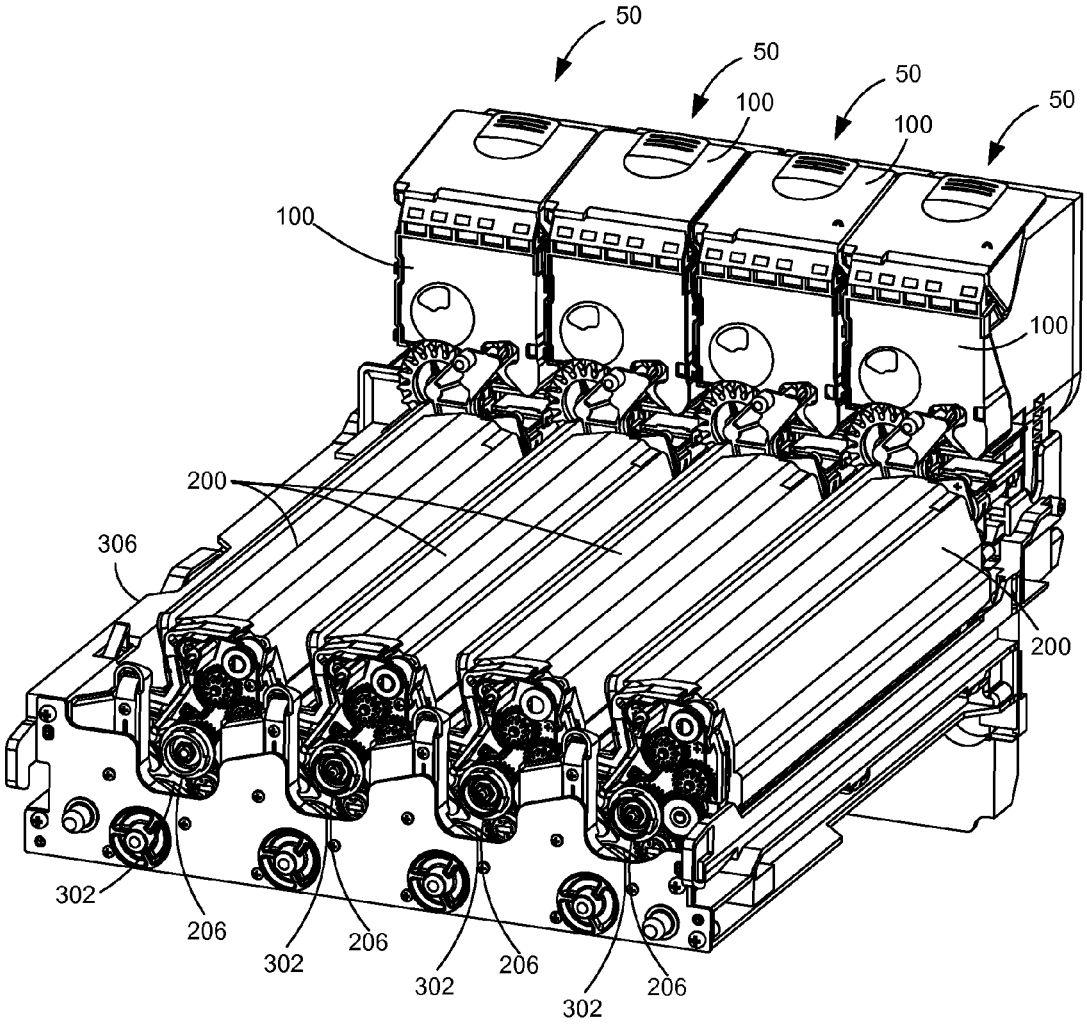
FIG. 2 is a perspective view of four imaging stations each having a toner cartridge and a developer unit for use with the image forming device according to one example embodiment.

A monocolor image forming device 20 may include a single imaging station 50, as compared to a color image forming device 20 that may include multiple imaging stations 50. FIG. 2 illustrates a set of four imaging stations 50 that each includes a respective cartridge 100, developer unit 200, and PC drum 302 mounted in a frame 306 of PC unit 300. In one embodiment, frame 306 is manufactured out of stamped metal plates that result in precise control of the location of PC drums 302 relative to one another and relative to ITM belt 54, printhead 52, and drive modules within image forming device 20. Frame 306 includes a central opening sized to receive developer units 200 and to mate developer rolls 206 with their respective PC drums 302.

Figure 3:
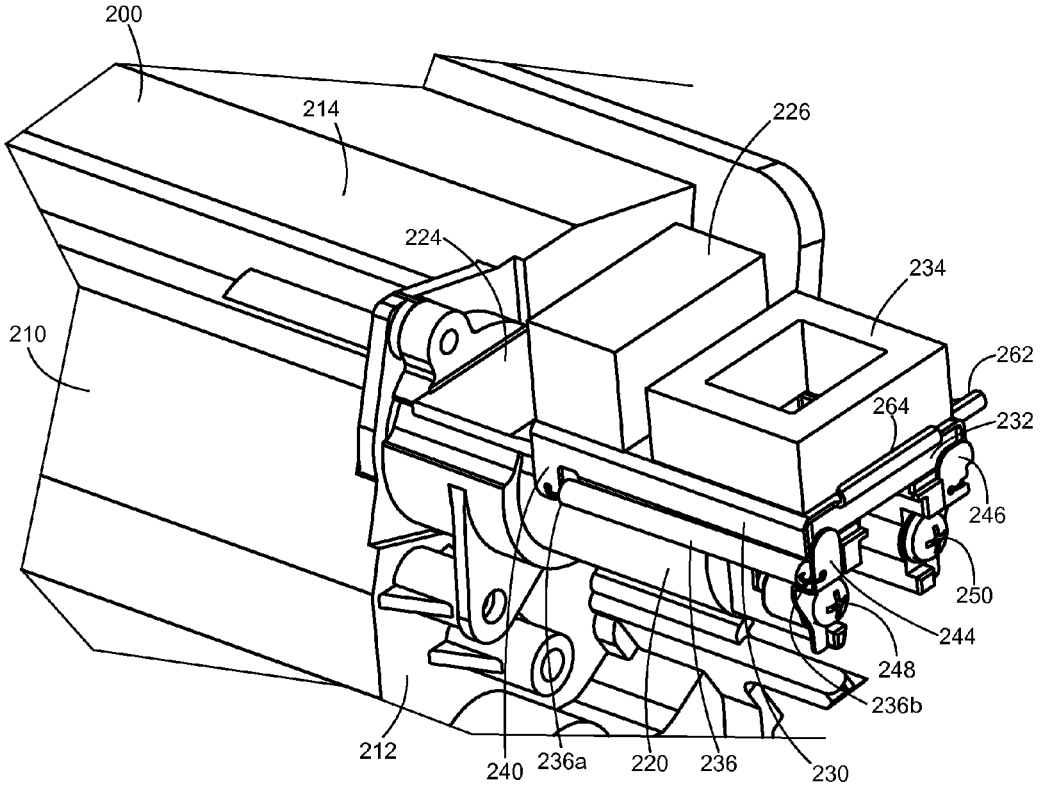
FIG. 3 is a perspective view of a shutter on an inlet port of the developer unit according to one example embodiment.

FIG. 3 shows a perspective view of a developer unit 200 in greater detail according to one example embodiment. Developer unit 200 is removably mounted in image forming device 20, such as in frame 306 discussed above. Reservoir 202, toner adder roll 204 and developer roll 206 discussed above are positioned within a housing 210 of developer unit 200. Housing 210 includes a shutter housing portion 220 that extends from a side portion 212 of developer housing 210. In one embodiment, shutter housing portion 220 is attached to a main housing portion 214 of developer housing 210 by suitable fasteners such as screws (not shown). Alternatively, shutter housing portion 220 may be ultrasonically welded to main housing portion 214 or formed integrally with main housing portion 214. A rotatable auger (not shown) protrudes from main housing portion 214 into shutter housing portion 220 in order to move toner from shutter housing portion 220 to main housing portion 214. Shutter housing portion 220 includes an inlet port 222 (see FIG. 5) that permits toner to enter developer unit 200 from cartridge 100. A shutter 230 is positioned on a top surface 224 of shutter housing portion 220 and is slidably movable between an open position (FIG. 6) and a closed position (FIG. 3). In the open position, shutter 230 permits toner to flow from cartridge 100 into developer unit 200 through inlet port 222. In the closed position, shutter 230 blocks inlet port 222 preventing toner from escaping developer unit 200.

Figure 4:
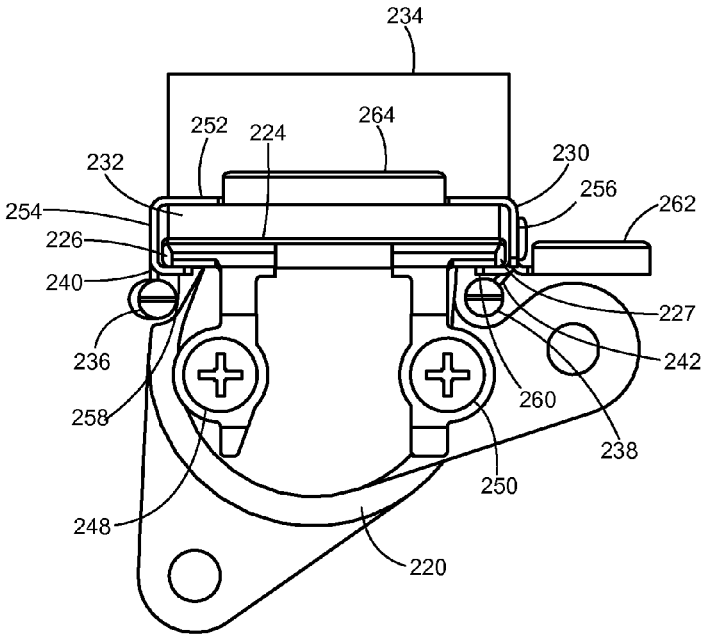
FIG. 4 is a side view of the shutter on the developer unit shown in FIG. 3.

With reference to FIGS. 3 and 4, a lower seal member 232 is attached to the bottom surface of shutter 230 and seals the interface between shutter 230 and shutter housing portion 220. An upper seal member 234 is attached to the top surface of shutter 230 and seals the interface between shutter 230 and cartridge 100 when cartridge 100 is installed. Lower seal member 232 and upper seal member 234 are movable with shutter 230. As shutter 230 slides between the closed position and the open position, lower seal member 232 slides against top surface 224 of shutter housing portion 220. In one embodiment, lower seal member 232 and upper seal member 234 are formed from an elastomeric foam material such as PORON® available from Rogers Corporation, Rogers, Conn., USA. However, lower seal member 232 and upper seal member 234 may be composed of any suitable material that provides an effective toner seal as long as shutter 230 is free to slide relative to shutter housing portion 220.

A pair of extension springs 236, 238 are positioned on opposite sides of shutter 230 that bias shutter 230 toward the closed position shown in FIG. 3. Springs 236, 238 are connected at one end to legs that extend from shutter 230. FIG. 3 shows end 236*a* of spring 236 connected to leg 240 extending from shutter 230; the connection for spring 238 is substantially the same but is obscured in FIG. 3. The other end of springs 236, 238 is connected to a respective anchor 244, 246 mounted on shutter housing portion 220. Again, end 236*b* of spring 236 is shown in FIG. 3 but spring 238 is not. In the example embodiment illustrated, anchors 244, 246 are mounted to shutter housing portion 220 by fasteners such as screws 248, 250, respectively; however, any suitable mounting method may be used such as by welding anchors 244, 246 to shutter housing portion 220 or by forming anchors 244, 246 integrally with shutter housing portion 220. Springs 236, 238 bias shutter 230 against anchors 244, 246. In addition to providing an attachment point for springs 236, 238, anchors 244, 246 serve as stops to limit the sliding motion of shutter 230 as it returns to the closed position shown in FIG. 3.

With reference to FIG. 4, a side view of shutter housing portion 220 is shown with shutter 230 mounted thereon. Anchors 244, 246 are removed from FIG. 4 in order to more clearly display the features of shutter 230 and shutter housing portion 220. As shown, shutter housing portion 220 includes a pair of ledges 226, 227 on opposite sides of inlet port 222. Shutter 230 includes a top portion 252 and a pair of side portions 254, 256 that extend downward from top portion 252. Legs 240, 242 are formed from a respective segment of each side portion 254, 256 proximate to main housing portion 214. Shutter 230 also includes a pair of tabs 258, 260 that extend from side portions 254, 256, respectively. Tabs 258, 260 wrap under and contact the bottom surface of ledges 226, 227, respectively. Lower seal member 232 is sandwiched between top portion 252 of shutter 230 and top surface 224 of shutter housing portion 220. In one embodiment, the distance from top surface 224 of shutter housing portion 220 to the bottom surface of top portion 252 of shutter 230 is less than the nominal thickness of lower seal member 232 such that lower seal member 232 is compressed to ensure that the interface between shutter 230 and shutter housing portion 220 is sealed. Shutter 230 includes an arm 262 that extends from side portion 256 away from shutter housing portion 220. Shutter 230 also includes a lip 264 formed at the edge of top portion 252 furthest from main housing portion 214. As discussed in greater detail below, arm 262 and lip 264 are positioned to receive an actuation force from a corresponding pair of engagement features on toner cartridge 100 in order to open shutter 230 when toner cartridge 100 is installed.

Figure 5:
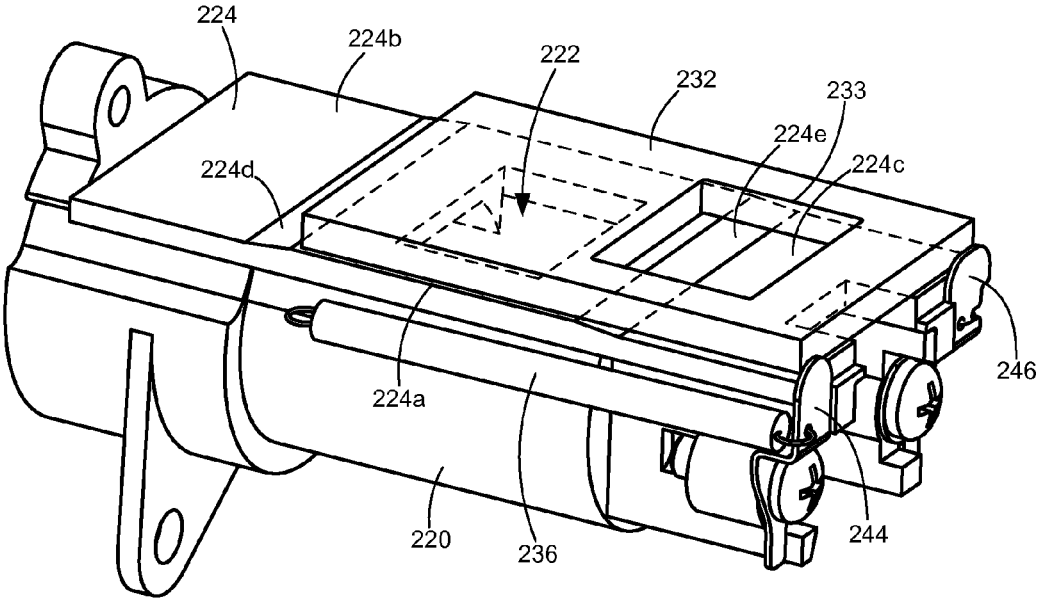
FIG. 5 is a perspective view of a lower seal member and a shutter housing for use with the developer unit according to one example embodiment.

FIG. 5 shows shutter housing portion 220 with shutter 230 and upper seal member 234 removed in order to more clearly illustrate lower seal member 232. Inlet port 222 is shown in dashed lines to illustrate its position on top surface 224 of shutter housing portion 220 beneath lower seal member 232. Lower seal member 232 is shown in the closed position with its body covering and blocking inlet port 222. Lower seal member includes an opening 233 through an interior portion of its body that has a size and shape similar to that of inlet port 222. In the example embodiment illustrated, top surface 224 of shutter housing portion 220 includes a raised portion 224*a* that surrounds inlet port 222 to ensure that lower seal member 232 is sufficiently compressed to seal inlet port 222. The elevation of top surface 224 on each side of inlet port 222 in portions 224*b* and 224*c*, which are in the sliding path of shutter 230, is lower than raised portion 224*a* since sealing is less critical in these regions as compared with inlet port 222. Ramped portions 224*d*, 224*e* provide a gradual transition from portions 224*b*, 224*c*, respectively, to raised portion 224*a*. Reducing the elevation of top surface 224 in portions 224*b* and 224*c* decreases the compression of lower seal member 232 in those regions. This reduces unwanted drag on lower seal member 232 from top surface 224 during the actuation of shutter 230 and lowers the overall energy required to actuate shutter 230. In one embodiment, the elevation of raised portion 224*a* is about 0.25 mm higher than portions 224*b* and 224*c* and the nominal compression of lower seal member is about 0.6 mm.

Figure 6:
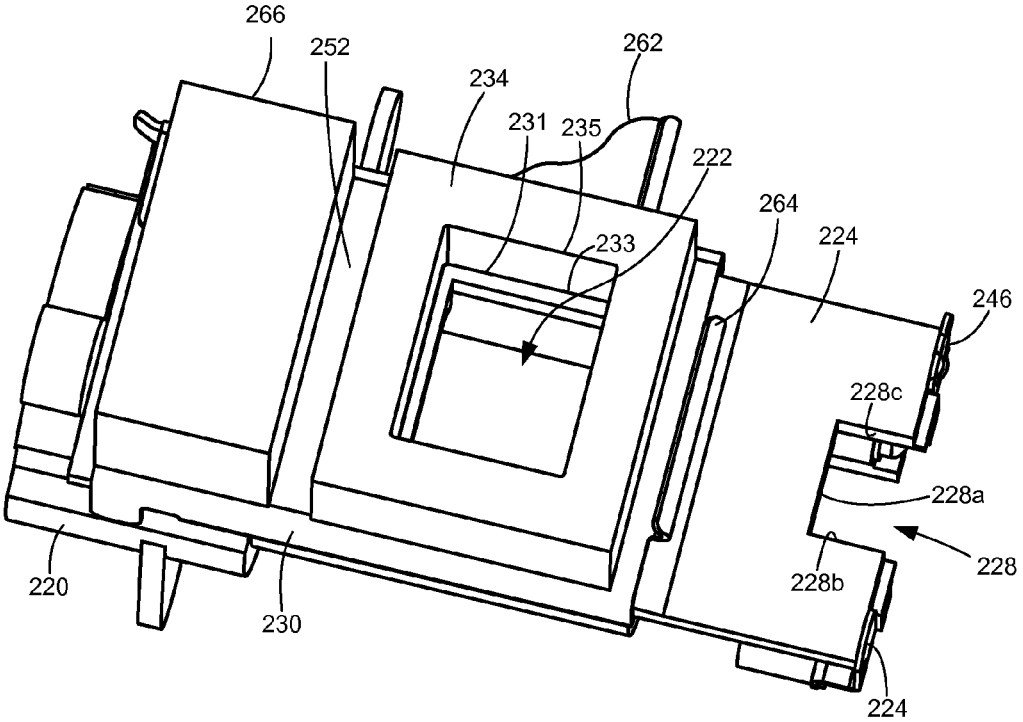
FIG. 6 is a perspective view of the shutter on the developer unit shown in FIG. 3 in the open position according to one example embodiment.

FIG. 6 shows a top perspective view of shutter 230 in the open position. Shutter 230 and upper seal member 234 include openings 231, 235, respectively, that are sized and shaped similar to opening 233 in lower seal member 232. As shutter 230 opens, shutter 230 slides to the left as viewed in FIG. 6 until openings 231, 233, 235 are positioned over inlet port 222 to permit toner to flow from toner cartridge 100 into shutter housing portion 220 so that it can then be drawn into main housing portion 214. Shutter housing portion 220 includes a cutout 228 at the edge of shutter housing portion 220 furthest from main housing portion 214. Cutout 228 includes a back edge 228*a* and two side edges 228*b*, 228*c*. As discussed in greater detail below, cutout 228 is positioned to allow an engagement feature on toner cartridge 100 to contact lip 264 and actuate shutter 230 when toner cartridge 100 is installed.

In the example embodiment illustrated, shutter 230 also includes a foam member 266 positioned on top portion 252 of shutter 230 proximate to main housing portion 214. Foam member 266 aids in soaking up any toner escaping from toner cartridge 100 as toner cartridge 100 is removed and shutter 230 is moved to the closed position. Foam member 266 may include a flexible, open cell, polymer (e.g., polyurethane) foam, such as SUPER SEAL FOAM available from FXI, Media, Pa., USA.

Figure 7:
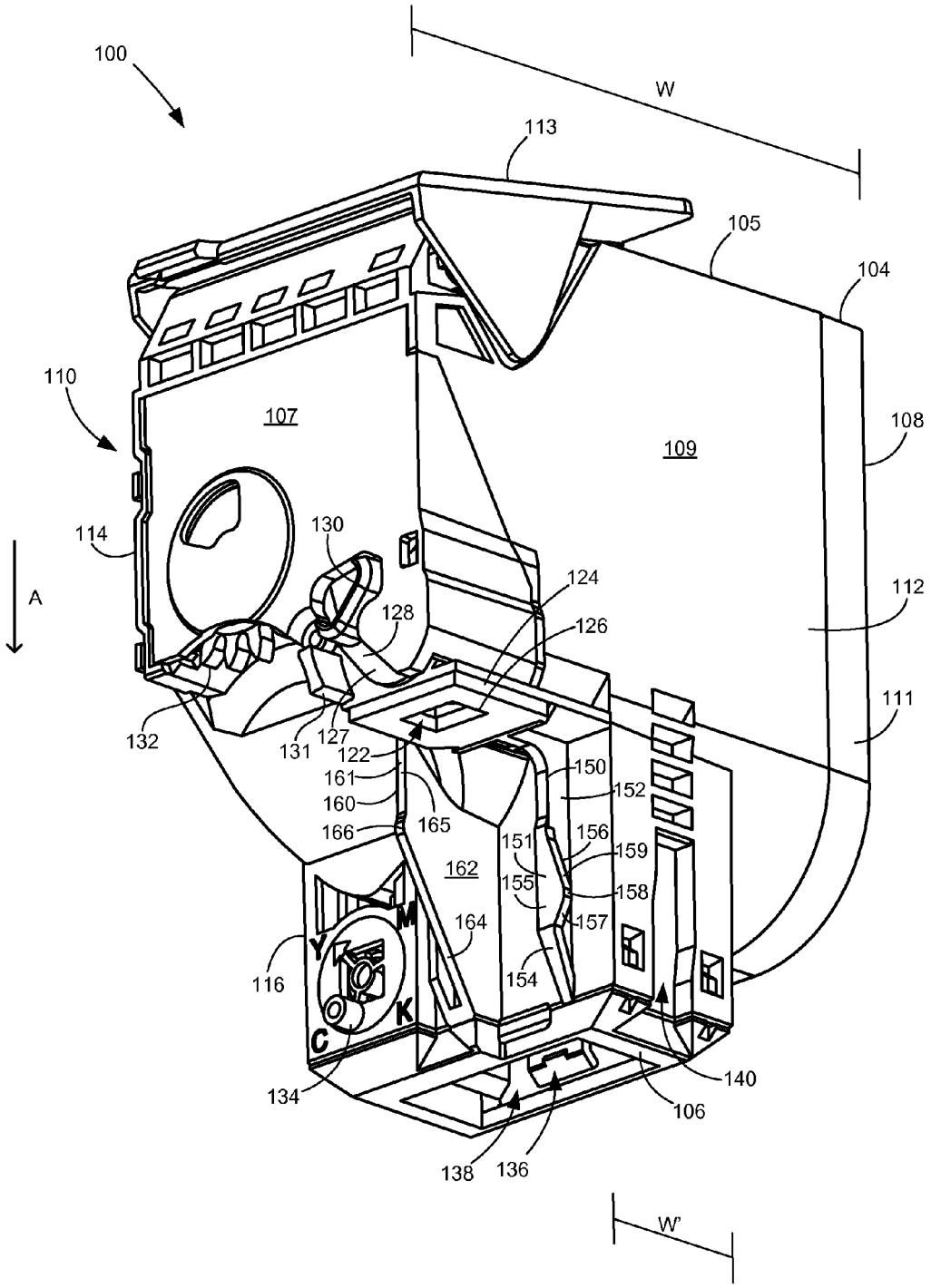
FIG. 7 is a perspective view of a toner cartridge for use with the developer unit according to one example embodiment.

FIG. 7 shows a perspective view of toner cartridge 100. Toner cartridge 100 includes a housing 104 having a top 105, a bottom 106, a front 107, a rear 108 and a pair of sides 109, 110 and forming reservoir 102 therein. In one embodiment, housing 104 is comprised of an end cap 111 mounted on, such as by ultrasonic welding, a main housing 112 at the rear 108 of cartridge 100. A handle 113 may be positioned on top 105 to facilitate grasping and manipulating cartridge 100 during insertion and removal from image forming device 20. In one embodiment, handle 113 is pivotally attached to housing 104. Housing 104 includes a main section 114 and an extension section 116. Extension section 116 is positioned at the bottom 106 of housing 104. As illustrated in FIG. 7, a depth W' of extension section 116 measured between the front 107 and rear 108 is smaller than a depth W of main section 114. Toner cartridge 100 includes an overall height measured between the top 105 and the bottom 106. In one embodiment, extension section 116 includes a smaller) height than main section 114.

Toner cartridge 100 includes an outlet port 122 for transferring toner to developer unit 200 through inlet port 222. Outlet port 122 is formed as a downward facing opening on main section 114 on the front 107 of housing 104. Outlet port 122 includes a seal member 124 that mates with upper seal member 234 of shutter 230 when cartridge 100 is installed in image forming device 20. Like upper seal member 234, seal member 124 includes an opening 126 that is sized and shaped to permit toner to flow from outlet port 122 into inlet port 222. Outlet port 122 includes a shutter 127 positioned therein that regulates whether toner is permitted to flow from reservoir 102 out of outlet port 122. Shutter 127 may be rotatable between a closed position that prevents toner from exiting outlet port 122 and an open position that permits toner to flow out of outlet port 122. Shutter 127 is biased toward the closed position by an over-center spring (not shown) to prevent toner from escaping unless toner cartridge 100 is installed within image forming device 22. Shutter 127 includes a cylindrical body having a hollow interior and an exit opening. In the closed position, the exit opening is positioned away from outlet port 122 to prevent toner movement. In the open position, the exit opening of shutter 127 is aligned with outlet port 122 to allow toner movement. In one embodiment, shutter 127 is of the type shown and described in U.S. Pat. No. 7,606,520 entitled "Shutter for a Toner Cartridge for use with an Image Forming Device," which is assigned to the assignee of the present application and incorporated herein by reference. Shutter 127 includes a face 128 that is exposed on the front 107 of housing 104. Face 128 includes a cupped notch 130 that contacts a corresponding engagement feature on developer unit 200 when toner cartridge 100 is inserted into image forming device 20 to control rotation of the shutter between the closed and open positions as discussed in greater detail below. A guide 131 in the form of an angled projection is positioned on the front 107 of main section 114. Guide 131 is spaced from shutter 127 toward side 110 and assists in ensuring that shutter 127 is opened properly when cartridge 100 is inserted as discussed in greater detail below.

Toner cartridge 100 further includes a drive gear 132 positioned on the front 107 of housing 104. Drive gear 132 meshes with and receives rotational power from a corresponding gear in image forming device 20 in order to provide rotational power to various paddles and/or agitators and an auger positioned within reservoir 102 for moving toner to outlet port 122. In the example embodiment illustrated, drive gear 132 is partially covered with only a few teeth exposed on a bottom portion thereof. Drive gear 132 is positioned on main section 114 of housing 104 above outlet port 122.

Where multiple toner cartridges 100 are used with a single image forming device 20, toner cartridge 100 may include a keying structure 134 that prevents a toner cartridge 100 from being inserted in the wrong location. For example, where each toner cartridge 100 in image forming device 20 provides a different color toner, such as where toner cartridges having black, cyan, yellow and magenta toners are used, keying structure 134 prevents each toner cartridge 100 from being inserted into the location corresponding with any other color. For example, keying structure 134 prevents a toner cartridge 100 containing cyan colored toner from being positioned in the location for a black, yellow or magenta toner cartridge. In the example embodiment illustrated, keying structure 134 is positioned on the front 107 of extension section 116 of housing 104.

Toner cartridge 100 may also include an electrical connector 136 having processing circuitry for communicating with a controller of image forming device 20. The processing circuitry may provide authentication functions, safety and operational interlocks, operating parameters and usage information related to toner cartridge 100. In the example embodiment illustrated, electrical connector 136 is positioned in a recess 138 in the bottom 106 of housing 104. When toner cartridge 100 is installed in image forming device 20, contacts on electrical connector 136 mate with corresponding contacts to establish a communication link to the controller of image forming device 20. In one embodiment, electrical connector 136 is of the type shown and described in U.S. Pat. No. 7,272,336 entitled "Cartridge with a Movable Electrical Connector," which is assigned to the assignee of the present application and incorporated herein by reference.

Toner cartridge 100 may also include various alignment members 140 that align toner cartridge 100 with developer unit 200 during insertion of toner cartridge 100 in the direction shown by arrow A in FIG. 7. For example, alignment members 140 may include a combination of projections that project outwardly from sides 109, 110 of housing 104 and/or elongated slots formed as depressions in sides 109, 110 that mate with corresponding slots and/or projections, respectively, to ensure accurate positioning of toner cartridge 100. For example, alignment members 140 help ensure that outlet port 122 mates with inlet port 222 of developer unit 200, that drive gear 132 mates with the corresponding drive gear in image forming device 20, and that electrical connector 136 mates with corresponding electrical contacts.

Figure 8:
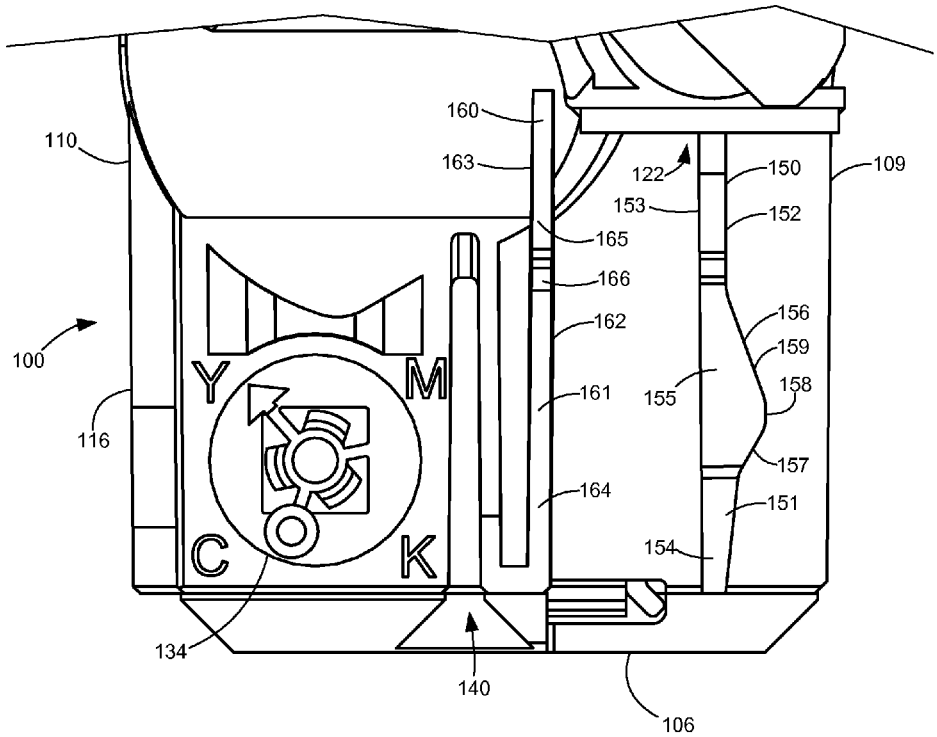
FIG. 8 is a front elevation view of a portion of the toner cartridge shown in FIG. 7.
Figure 9:
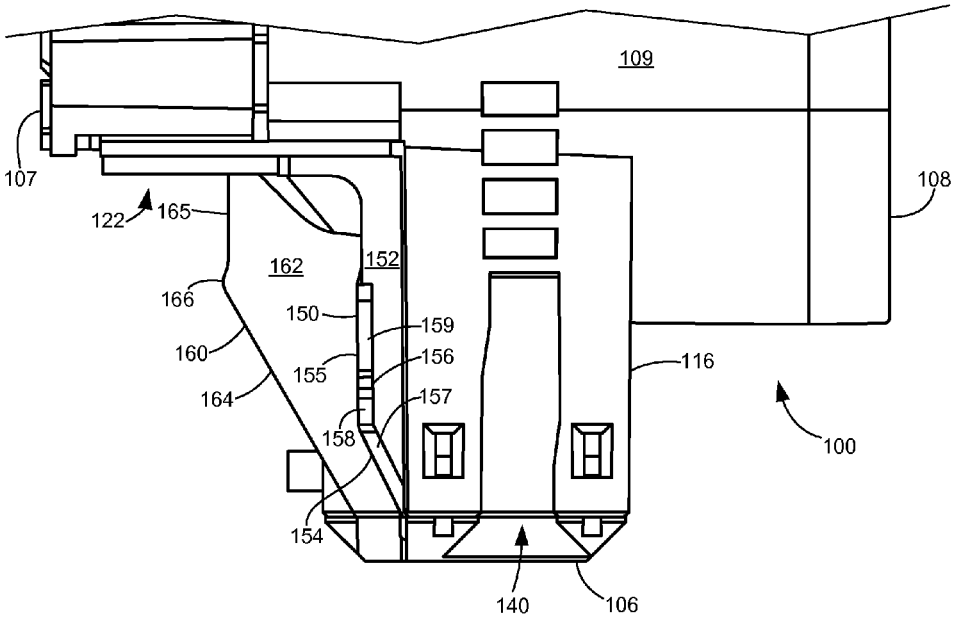
FIG. 9 is a side elevation view of a portion of the toner cartridge shown in FIG. 7.

Toner cartridge 100 also includes a first engagement member 150 and a second engagement member 160 spaced from each other on the front 107 of extension section 116 for actuating shutter 230 on developer unit 200 when toner cartridge 100 is inserted into image forming device 20. Engagement members 150 and 160 project from front 107 of extension section 116. FIGS. 8 and 9 show close-up front and side elevation views, respectively, of toner cartridge 100 to more clearly illustrate the features of engagement members 150 and 160. In the example embodiment illustrated, engagement members 150 and 160 are formed as narrow ribs that are formed integrally in housing 104. Alternatively, engagement members 150, 160 may be attached to front 107 of housing 104 such as by one or more fasteners or an adhesive. Engagement member 150 is aligned horizontally on front 107 of housing 104 with outlet port 122. Engagement member 160 is spaced from engagement member 150 toward the center of front 107 of extension section 116 (i.e., toward side 110).

Engagement member 150 includes a front face 151 and a pair of sides 152, 153. Side 152 faces toward side 109 of cartridge 100 and side 153 faces toward side 110 and engagement member 160. Front face 151 includes a leading ramped front surface 154 that gradually projects further outward from front 107 as it travels upward away from bottom 106. Ramped front surface 154 leads into a vertical front surface 155 that extends substantially vertically. Accordingly, ramped front surface 154 is positioned below vertical front surface 155. In the example embodiment illustrated, engagement member 150 further includes an alignment feature 156 that projects from side 152. Alternatively, alignment feature 156 may project from front 107 of housing 104 separate from engagement member 150. Alignment feature 156 includes a first ramped side surface 157 that gradually projects further outward from side 152 as it travels upward. First ramped side surface 157 ends at a peak 158 and then leads into a second ramped side surface 159. The outward projection of second ramped side surface 159 from side 152 gradually reduces as it travels upward. In other words, alignment feature 156 gradually bows outward from side 152 and then back inward. Ramped side surface 157 is positioned below peak 158 and peak 158 is positioned below ramped side surface 159. In the example embodiment illustrated, peak 158 of alignment feature 156 is aligned vertically with vertical front surface 155 of front face 151 (i.e., the height of peak 158 from bottom 106 is equal to a point on vertical front surface 155 of front face 151). Further, in the example embodiment illustrated, peak 158 includes a surface that extends substantially vertically, substantially parallel to the direction of insertion of toner cartridge 100.

Engagement feature 160 includes a front face 161 and a pair of sides 162, 163. Side 162 faces toward side 109 of cartridge 100 and engagement member 150 and side 163 faces toward side 110. Front face 161 includes a leading ramped front surface 164 that gradually projects further outward from front 107 as it travels upward away from bottom 106.

Front face 161 further includes a vertical front surface 165 that extends substantially vertically such that it is substantially parallel to vertical front surface 155 of engagement feature 150. Engagement feature 160 may also optionally include a forward projecting bump 166 where ramped front surface 164 leads into vertical front surface 165. Bump 166 projects further forward from front 107 than ramped front surface 164 and vertical front surface 165. In one embodiment, bump 166 projects about 0.5 mm further forward than vertical front surface 165. Ramped front surface 164 is positioned below bump 166 and bump 166 is positioned below vertical front surface 165. Further, vertical front surface 165 and at least a portion of ramped front surface 164 proximate to vertical front surface 165 of engagement feature 160 project further outward from front 107 than vertical front surface 155 of engagement feature 150. Although ramped front surfaces 154, 164 are illustrated as having a substantially flat, planar surface, all or a portion of either or both of ramped front surfaces 154, 164 may have a curved surface instead.

Figure 10:
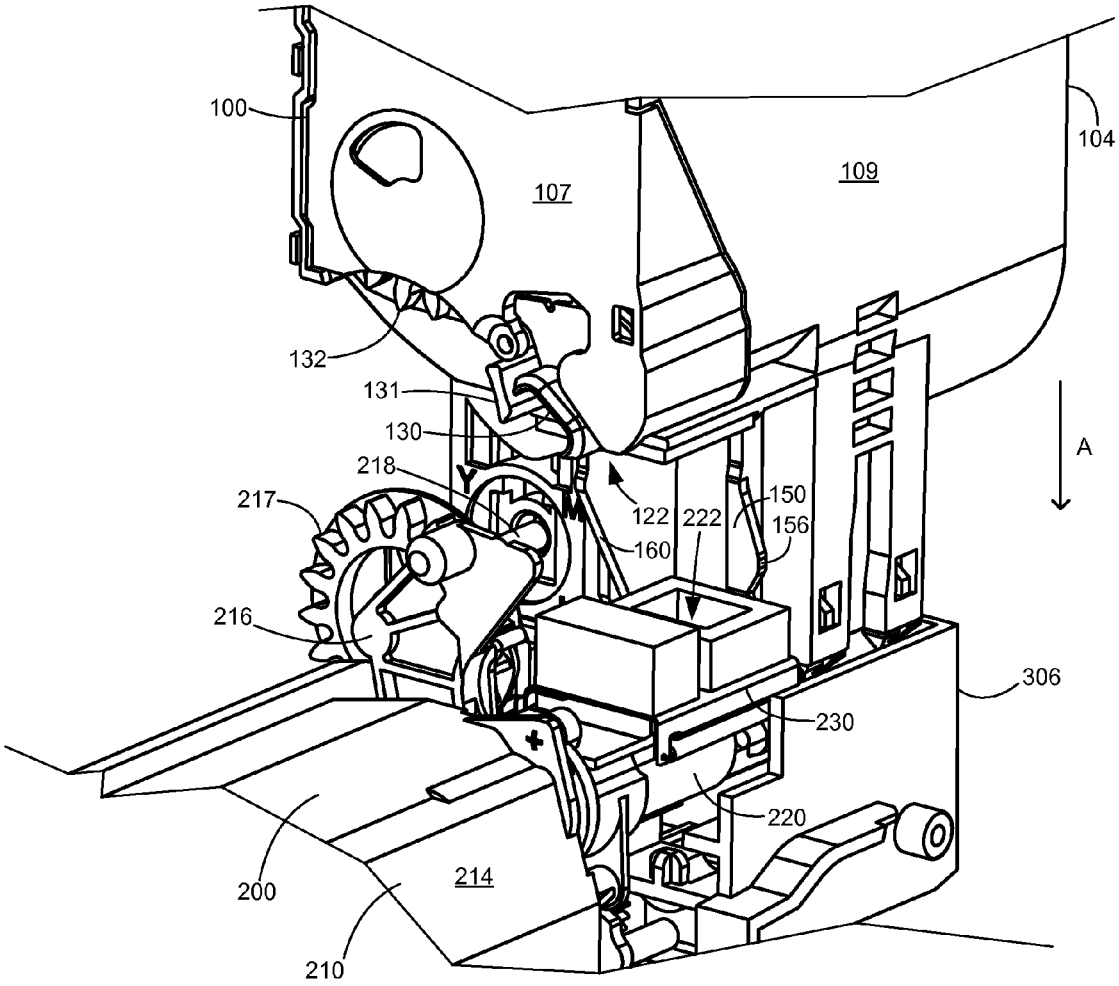
FIG. 10 is a perspective view of the toner cartridge as it is inserted into the image forming device to be mated with the developer unit according to one example embodiment.

Shutter 230 on developer unit 200 is actuated by engagement members 150 and 160 on toner cartridge 100. Engagement member 150 provides the initial force to begin opening shutter 230 and engagement member 160 provides the remaining force to move shutter 230 the rest of the way to the open position and the force to hold shutter 230 in the open position. FIG. 10 shows a perspective view of toner cartridge 100 as it is first inserted into frame 306 of PC unit 300 for mating with developer unit 200. Cartridge 100 is inserted in direction of insertion arrow A toward a seated position in frame 306 where outlet port 122 is mated with inlet port 222 of developer unit 200. As shown in FIG. 10, developer housing 210 includes a gear plate 216 extending upward therefrom. Gear plate 216 includes a drive gear 217 that mates with and provides rotational power to drive gear 132 on cartridge 100 when cartridge 100 is fully inserted. Gear plate 216 also includes a pin 218 that projects toward toner cartridge 100. Pin 218 is positioned to engage notch 130 on the front 107 of toner cartridge 100. The motion of insertion causes pin 218 to rotate shutter 127 to the open position.

Figure 11A:
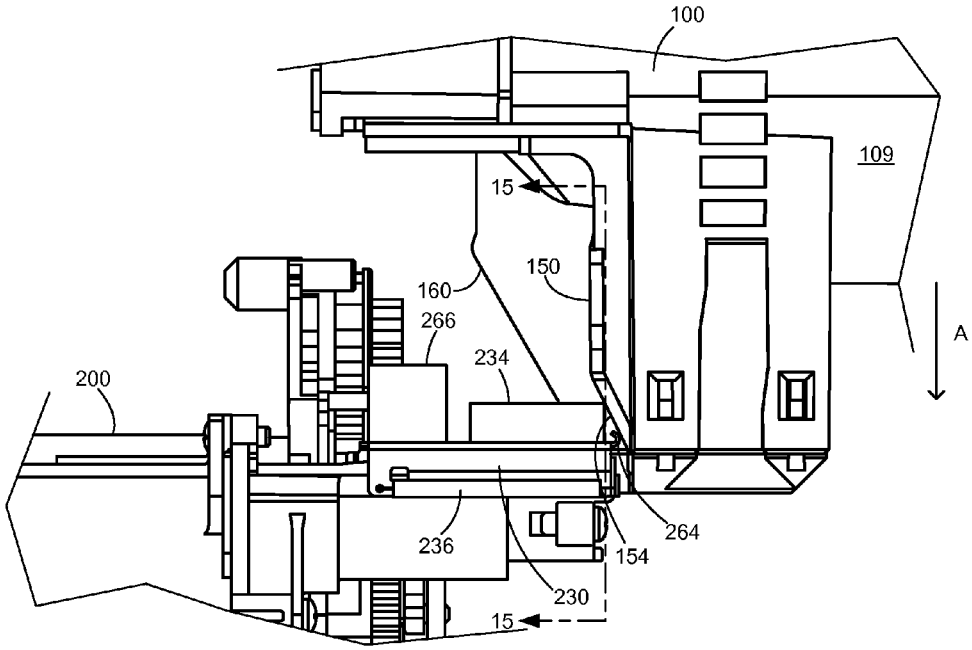
FIGS. 11A and 11B are a side elevation view and a perspective view, respectively, of the toner cartridge as it approaches its seated position in the image forming device according to one example embodiment.
Figure 11B:
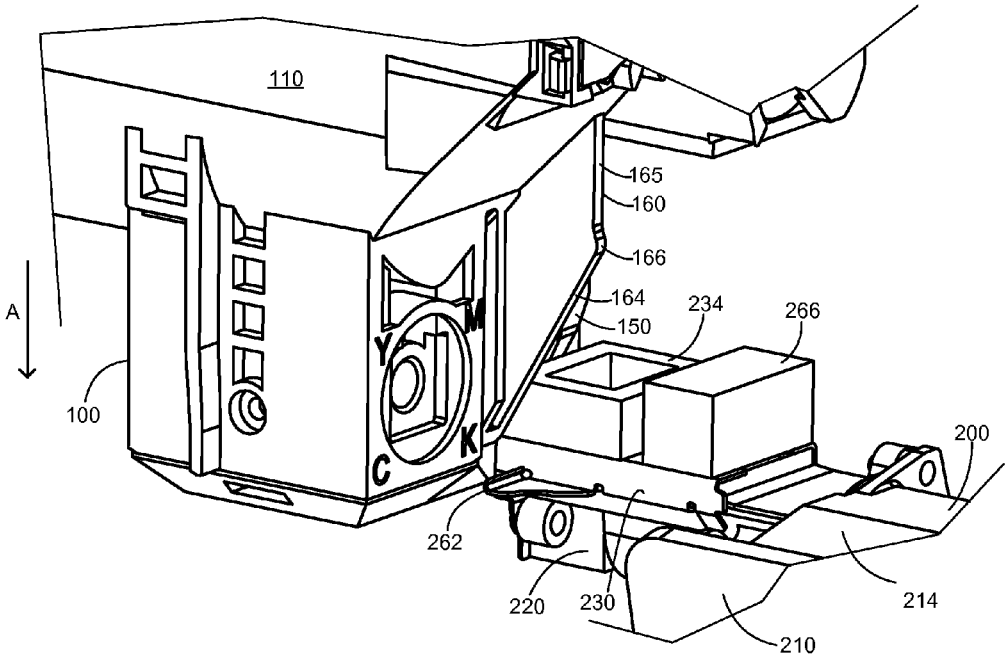

FIGS. 11A and 11B show toner cartridge 100 as it approaches its seated position with PC unit 300 removed to more clearly illustrate the interaction between cartridge 100 and developer unit 200. Toner cartridge 100 moves in a vertically downward direction as indicated by direction of insertion arrow A. As shown in FIG. 11A, as toner cartridge 100 moves downward, ramped front surface 154 of engagement member 150 contacts lip 264 on shutter 230. As toner cartridge 100 continues to advance, the contact point between lip 264 and engagement member 150 travels up ramped front surface 154 causing shutter 230 (as well as upper and lower seal members 234 and 232) to begin to slide toward the open position (to the left as viewed in FIG. 11A). Specifically, the force from ramped front surface 154 overcomes the biasing force applied to shutter 230 by springs 236, 238 thereby extending springs 236, 238. As shown in FIG. 11B, when ramped front surface 154 first contacts lip 264 of shutter 230, engagement member 160 is spaced away from and does not contact shutter 230. Engagement member 150 travels within cutout 228 in shutter housing portion 220 (FIG. 6) as toner cartridge 100 moves further downward.

Figure 12A:
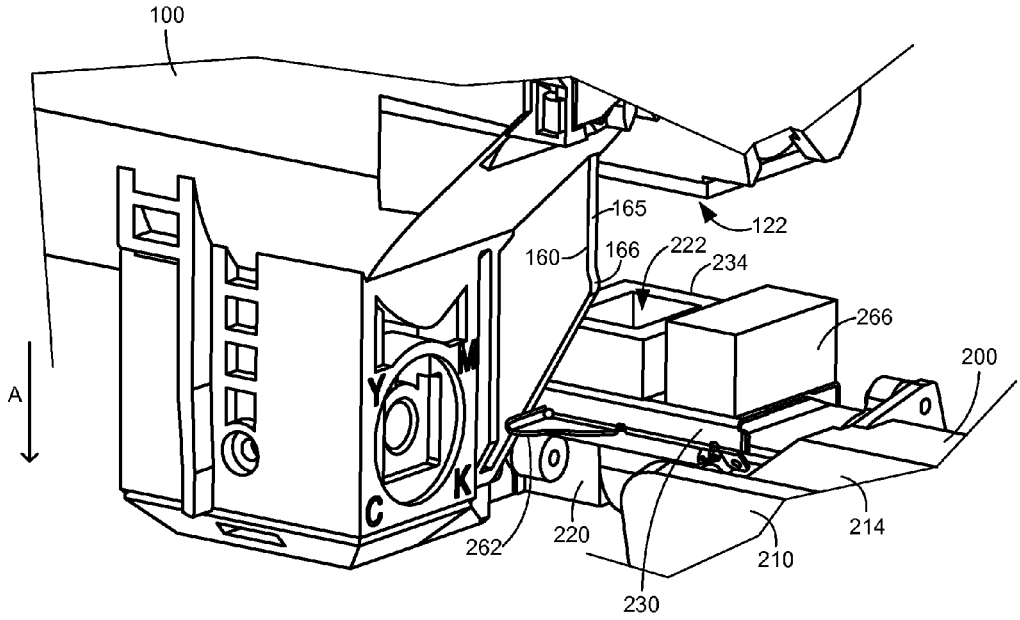
FIGS. 12A and 12B are perspective views of the toner cartridge shown in FIGS. 11A and 11B advanced further toward its seated position in the image forming device.
Figure 12B:
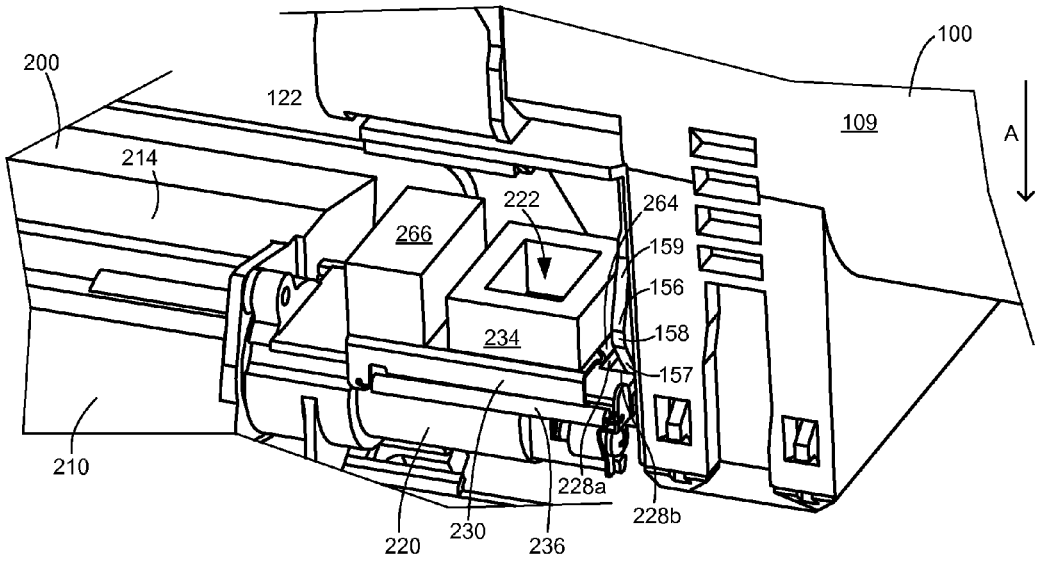

FIGS. 12A and 12B show toner cartridge 100 advanced further toward its seated position with PC unit 300 again removed for clarity. As toner cartridge 100 continues to advance, ramped front surface 164 of engagement member 160 contacts arm 262 extending from shutter 230 as shown in FIG. 12A. The contact point between arm 262 and engagement member 160 travels up ramped front surface 164 toward vertical front surface 165 as toner cartridge 100 continues to move downward. This causes shutter 230 to continue to slide toward the open position (to the left as viewed in FIG. 12B). As arm 262 continues to travel up ramped front surface 164, lip 264 separates from ramped front surface 154 and shutter 230 slides away from engagement member 150. As toner cartridge 100 advances further, vertical front surface 155 of engagement member 150 passes within cutout 228 spaced away from back edge 228*a*. At the same time, alignment feature 156 contacts side edge 228*b* as shown in FIG. 12B and exerts a force on shutter housing portion 220 that is substantially orthogonal to the direction of movement of shutter 230. The force from alignment feature 156 on side edge 228*b* positions developer unit 200 relative to cartridge 100 so that outlet port 122 is aligned with inlet port 222 and so that pin 218 is received by notch 130 to open shutter 127 as discussed in greater detail below.

Figure 13:
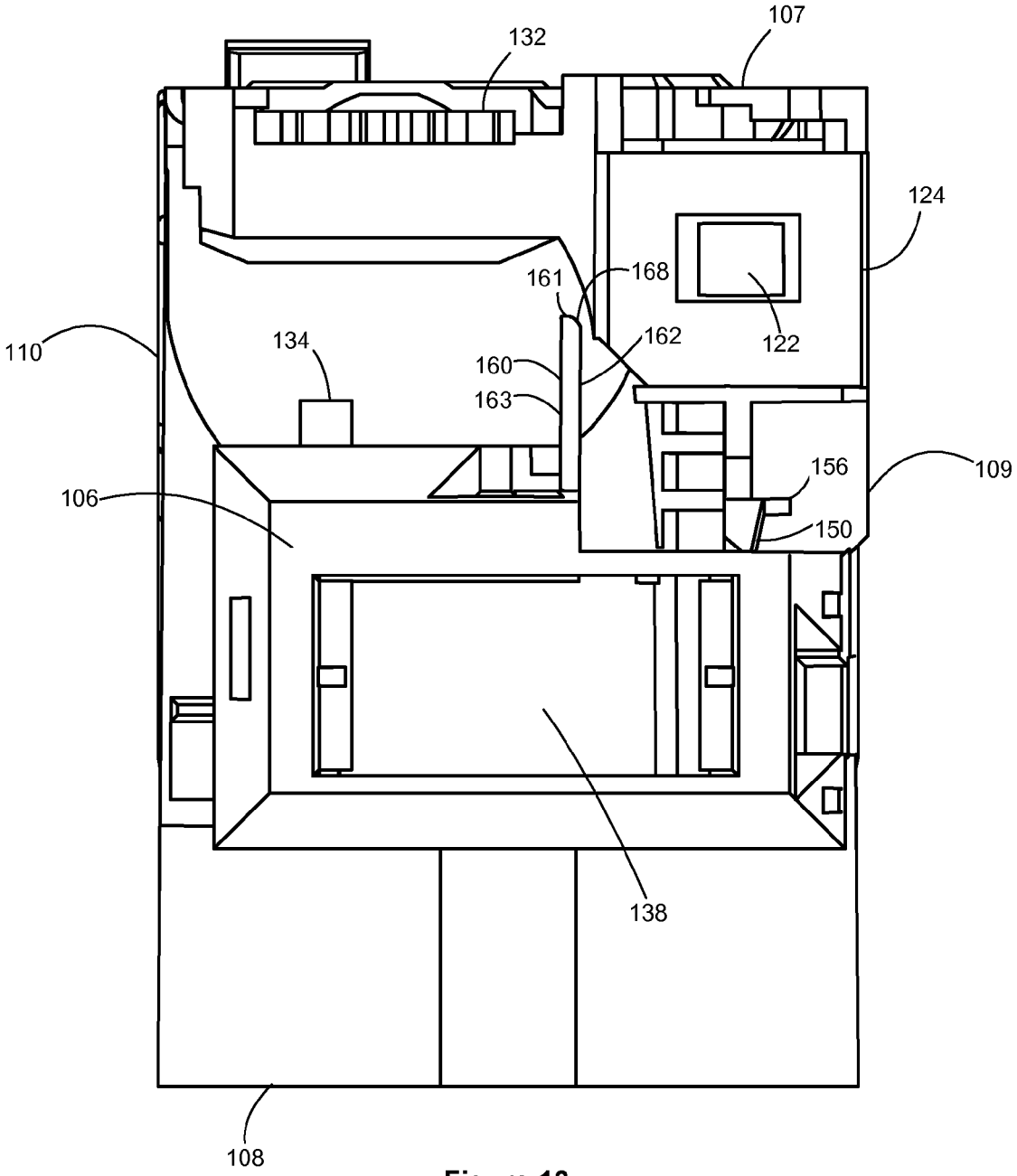
FIG. 13 is a bottom plan view of a toner cartridge for use with the developer unit having an engagement member that includes a radiused edge according to one example embodiment.

As toner cartridge 100 continues to advance, arm 262 continues to travel up ramped front surface 164 until arm 262 passes over bump 166 and reaches vertical front surface 165 where shutter 230 is in its final, open position. Bump 166 causes shutter 230 to over-travel by a small amount, which helps straighten lower seal member 232 relative to top surface 224 of shutter housing portion 220 so that in the final, open position of shutter 230, lower seal member 232 is more rectangular when viewed from the side (as in FIG. 11A). A rectangular shape (as opposed to an angled parallelogram shape) minimizes the likelihood of toner clinging to the walls of opening 233 in lower seal member 232 and restricting the flow of toner into shutter housing portion 220. In addition, as lower seal member 232 straightens, most of the shear stress in lower seal member 232 is relieved which significantly reduces the force vertical front surface 165 must exert on arm 262 to hold shutter 230 in its final, open position. Reduction of forces acting on developer unit 200 increases system robustness against print defects such as "white gapping." Bump 166 also provides tactile feedback to the user that cartridge 100 has reached its seated position in frame 306. Specifically, as the user pushes toner cartridge 100 into frame 306, cartridge 100 will "snap" into place as arm 262 transitions from ramped front surface 164 past bump 166 to vertical front surface 165. In one embodiment, as shown in FIG. 13, an edge 168 of engagement member 160 between front face 161 and side 162 is radiused or rounded instead of forming a sharp corner. This reduces the friction between arm 262 and edge 168 and, in turn, decreases the wear on engagement member 160 as toner cartridge 100 is inserted and removed over time.

Figure 14A:
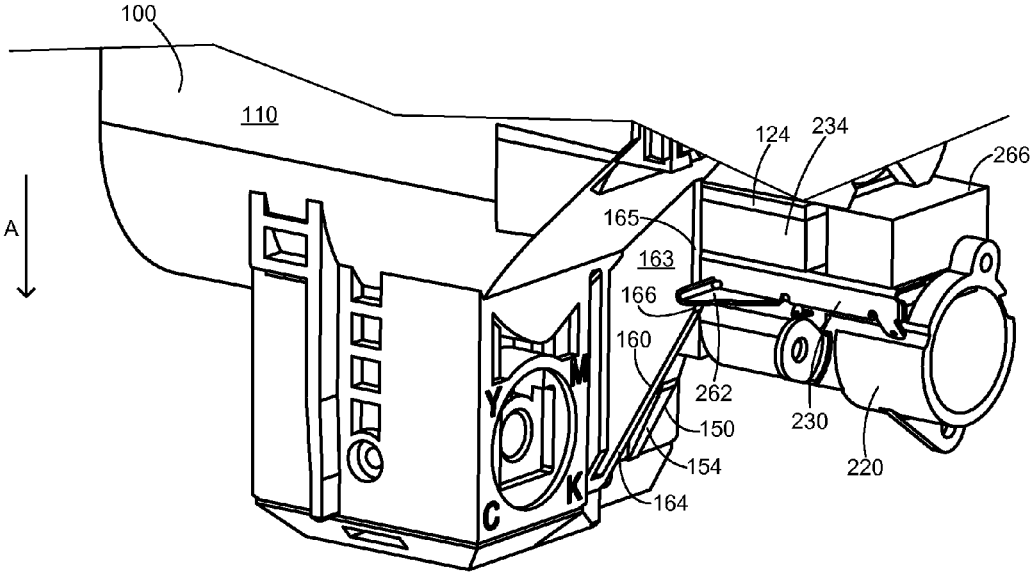
FIGS. 14A and 14B are perspective views of the toner cartridge shown in FIGS. 11A and 11B fully inserted into the image forming device and mated with the developer unit.
Figure 14B:
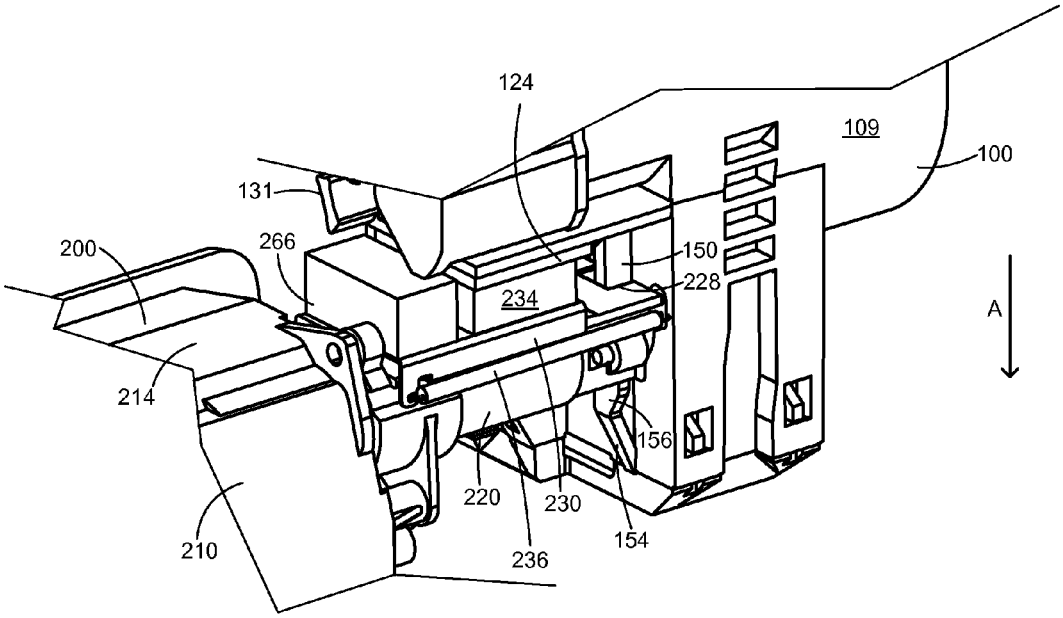

FIGS. 14A and 14B show toner cartridge 100 fully inserted and mated with developer unit 200 again with PC unit 300 removed for clarity. As shown in FIG. 14A, arm 262 rests against vertical front surface 165 holding shutter 230 in the open position. As shown in FIGS. 14A and 14B, upper seal member 234 surrounding inlet port 222 is mated with seal member 124 surrounding outlet port 122 to prevent toner from leaking as it flows from cartridge 100 to developer unit 200. Further, alignment feature 156 is spaced from back edge 228*a* and side edges 228*b*, 228*c* of cutout 228 such that engagement member 150 does not apply an undesired force on developer unit 200 that could disturb the precise positioning of developer roll 206 relative to its corresponding PC drum 302. Instead the force exerted by cartridge 100 on shutter 230 is substantially parallel to the axis of developer roll 206. Forces in this direction have less effect on the force balance of developer unit 200 than other forces and thus reduce the likelihood of developer roll 206 misalignment relative to PC drum 302 which could cause a print defect.

When toner cartridge 100 is removed, engagement members 150 and 160 disengage from shutter 230 allowing spring 236, 238 to return shutter 230 to the closed position against anchors 244, 246. The force exerted by springs 236, 238 is sufficient to overcome the friction between lower seal member 232 and top surface 224 of shutter housing portion 220. When toner cartridge 100 is removed and shutter 230 is in the closed position, openings 231, 233, 235 are positioned over top surface 224 of shutter housing portion 220 and spaced away from cutout 228 (FIGS. 3 and 5). This helps prevent any residual toner escaping outlet port 122 of toner cartridge 100 as cartridge 100 is removed from falling into and potentially contaminating image forming device 20. Rather, most of this toner will be collected by foam member 266 or caught against top surface 224 in the region formed by openings 231, 233, 235. If openings 231, 233, 235 were instead positioned over cutout 228, residual toner from cartridge 100 would tend to fall through cutout 228 and into image forming device 20.

Figure 15A:
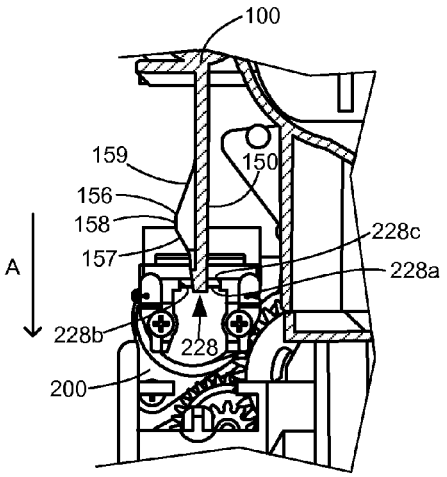
FIGS. 15A through 15E are sequential cross-sectional views taken along line 15-15 in FIG. 11A showing the positioning of the developer unit by an alignment member on the toner cartridge during insertion of the toner cartridge according to one example embodiment.
Figure 15B:
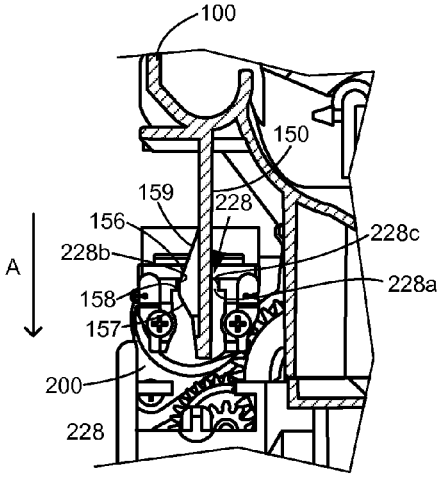
Figure 15C:
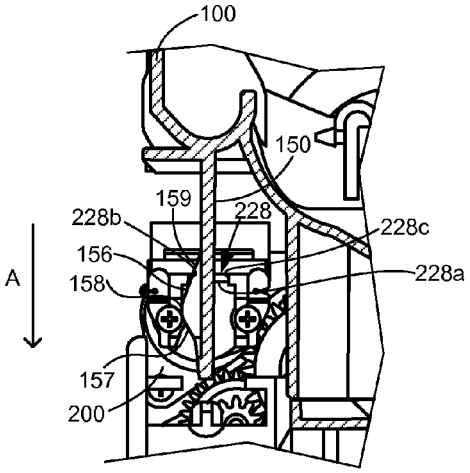
Figure 15D:
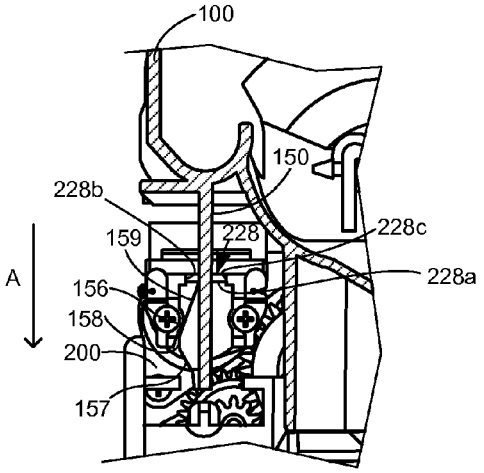
Figure 15E:
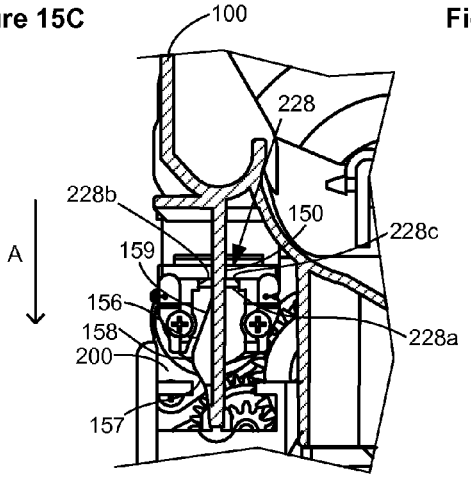

FIGS. 15A through 15E show a cross-section view along line 15-15 in FIG. 11A and illustrate the interaction between alignment feature 156 and shutter housing portion 220 during cartridge 100 insertion in more detail. FIG. 15A shows toner cartridge 100 approximately 24 mm from its seated position. As shown in FIG. 15A, as toner cartridge 100 is first inserted, engagement member 150 enters cutout 228 in shutter housing portion 220. As cartridge 100 advances further, side edge 228*b* contacts and travels up ramped side surface 157 until it reaches peak 158 (as shown in FIG. 15B which shows toner cartridge 100 approximately 13 mm from its seated position). When side edge 228*b* is in contact with peak 158, alignment feature 156 exerts the maximum bias on developer unit 200 to ensure that pin 218 contacts notch 130 to actuate shutter 127 as discussed below in conjunction with FIGS. 16A through 16E. As cartridge 100 continues to advance, side edge 228*b* travels up ramped side surface 159 (as shown in FIG. 15C which shows toner cartridge 100 approximately 8 mm from its seated position) until it separates from side edge 228*b* (as shown in FIG. 15D which shows toner cartridge 100 approximately 4 mm from its seated position). FIG. 15E shows toner cartridge 100 in its final seated position with alignment feature 156 spaced away from shutter housing portion 220 so as to avoid exerting an undesired force on developer unit 200.

Figure 16A:
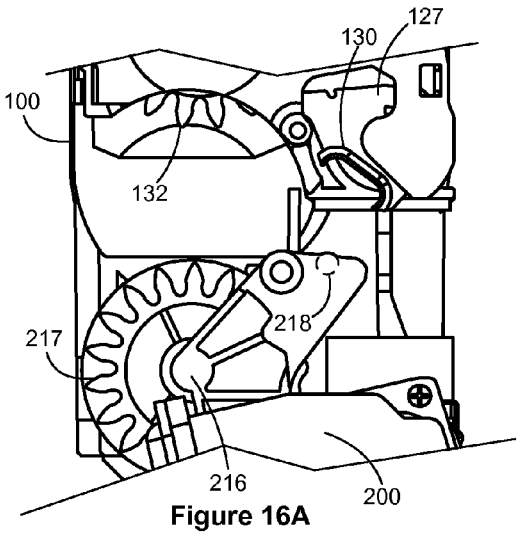
FIGS. 16A through 16E are sequential front elevation views showing the actuation of a shutter on the inlet port of the toner cartridge during insertion of the toner cartridge according to one example embodiment.
Figure 16B:
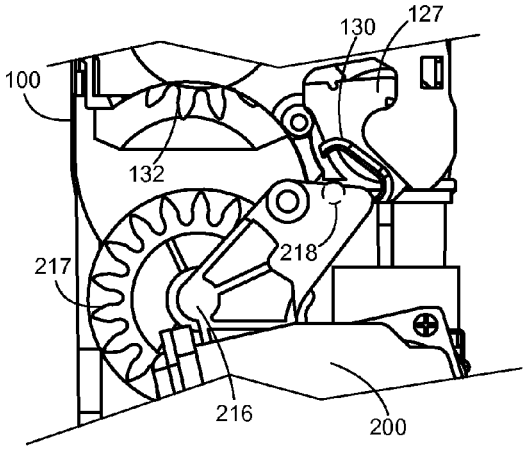
Figure 16C:
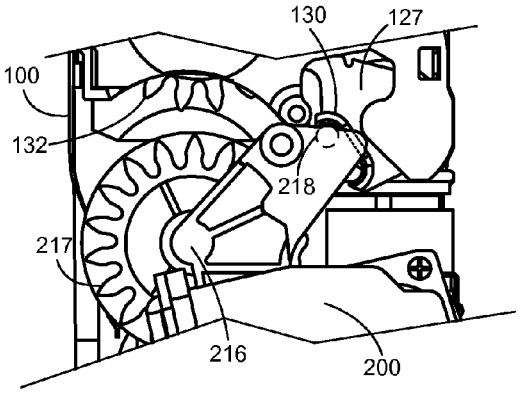
Figure 16D:
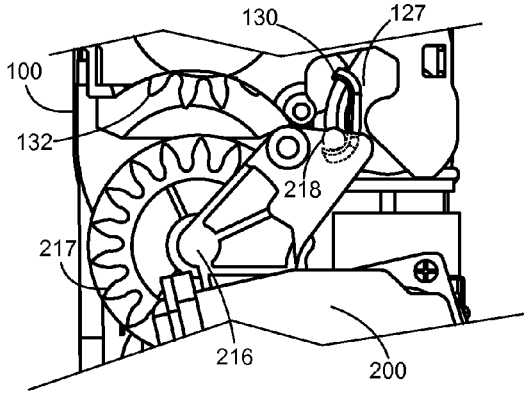
Figure 16E:
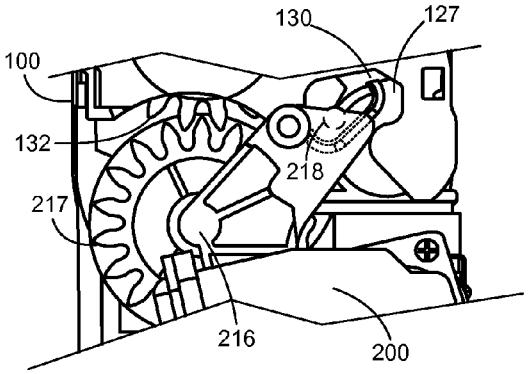

FIGS. 16A through 16E show the same intervals of cartridge 100 insertion as those shown in FIGS. 15A through 15E but from the front of cartridge 100. As discussed above, as toner cartridge 100 advances toward its seated position, alignment feature 156 biases developer unit 200 to the right as viewed in FIGS. 16A through 16E in order to align pin 218 with notch 130. Further, as shown in FIG. 16B, if pin 218 is misaligned relative to notch 130, guide 131 will contact pin 218 and urge pin 218 toward notch 130. FIG. 16C shows pin 218 contacting notch 130. FIG. 16D shows shutter 127 rotated to the open position by pin 218 and the over-center spring of shutter 127 such that pin 218 contacts the opposite side of the cupped notch 130. FIG. 16E shows cartridge 100 fully inserted with shutter 127 fully open. In this position, pin 218 is spaced away from shutter 127 such that it does not contact cartridge 100 in order to prevent an undesired force from cartridge 100 on developer unit 200. Shutter 127 remains in this position until cartridge 100 is removed. The removal causes notch 130 to again contact pin 218 which rotates shutter 127 to the closed position.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner cartridge for use with a developer unit of an image forming device, comprising:

a housing having a front, a rear, a top, a bottom and a pair of sides, the housing having a reservoir for holding toner;

an outlet port on the front of the housing for transferring toner from the reservoir to the developer unit through an inlet port on the developer unit;

a first engagement member projecting from the front of the housing positioned to provide an initial force to begin to open a shutter on the inlet port of the developer unit as the toner cartridge is inserted in the image forming device; and a second engagement member projecting from the front of the housing spaced toward one of the sides of the housing from the first engagement member and positioned to provide a force to continue to open the shutter on the inlet port of the developer unit as the toner cartridge is inserted further in the image forming device.

2. The toner cartridge of claim 1, wherein the first engagement member is aligned horizontally on the front of the housing with the outlet port.

3. The toner cartridge of claim 1, wherein each of the first engagement member and the second engagement member includes a leading ramped front surface that projects further forward as it travels up the front of the housing.

4. The toner cartridge of claim 3, wherein the ramped front surface of the second engagement member leads to a vertical front surface of the second engagement member positioned above the ramped front surface of the second engagement member.

5. The toner cartridge of claim 4, wherein the second engagement member includes a forward projecting bump separating the ramped front surface of the second engagement member and the vertical front surface of the second engagement member.

6. The toner cartridge of claim 4, wherein an edge of the second engagement member formed between the ramped front surface of the second engagement member and a side surface of the second engagement member facing the first engagement member is rounded.

7. The toner cartridge of claim 4, wherein the vertical front surface of the second engagement member and at least a portion of the ramped front surface of the second engagement member project further forward than the first engagement member.

8. The toner cartridge of claim 3, wherein the ramped front surface of the first engagement member leads to a vertical front surface of the first engagement member positioned above the ramped front surface of the first engagement member.

9. The toner cartridge of claim 1, further comprising an alignment member on the front of the housing for positioning the developer unit as the toner cartridge is inserted in the image forming device, the alignment member having a first ramped side surface that projects further sideways as the first ramped side surface travels up the front of the housing, the first ramped side surface leading to a second ramped side surface positioned above the first ramped side surface, the projection of the second ramped side surface decreasing as the second ramped side surface travels up the front of the housing.

10. The toner cartridge of claim 9, wherein the alignment member projects from a side surface of the first engagement member.

11. The toner cartridge of claim 10, wherein the alignment member projects from the side surface of the first engagement member away from the second engagement member.

12. A toner cartridge for use with a developer unit of an image forming device, comprising:

a housing having a front, a rear, a top, a bottom and a pair of sides, the housing having a reservoir for holding toner;

an outlet port on the front of the housing for transferring toner from the reservoir to the developer unit through an inlet port on the developer unit;

a first engagement member projecting from the front of the housing, the first engagement member having a first leading ramped front surface that projects further forward as it travels up the front of the toner cartridge, the first ramped front surface leading to a first vertical front surface positioned above the first ramped front surface; and a second engagement member projecting from the front of the housing spaced toward one of the sides of the housing from the first engagement member, the second engagement member having a second leading ramped front surface that projects further forward as it travels up the front of the toner cartridge, the second ramped front surface leading to a second vertical front surface positioned above the second ramped front surface, the second vertical front surface and at least a portion of the second ramped front surface projecting further forward than the first vertical front surface.

13. The toner cartridge of claim 12, wherein the first engagement member is aligned horizontally on the front of the housing with the outlet port.

14. The toner cartridge of claim 12, wherein the second engagement member includes a forward projecting bump separating the second ramped front surface and the second vertical front surface.

15. The toner cartridge of claim 12, wherein an edge of the second engagement member formed between the second ramped front surface and a side surface of the second engagement member facing the first engagement member is rounded.

16. The toner cartridge of claim 12, further comprising an alignment member on the front of the housing having a first ramped side surface that projects further toward one of the sides of the housing as the first ramped side surface travels up the front of the housing, the first ramped side surface leading to a second ramped side surface positioned above the first ramped side surface, the projection of the second ramped side surface toward said side of the housing decreasing as the second ramped side surface travels up the front of the housing.

17. The toner cartridge of claim 16, wherein the alignment member projects from a side surface of the first engagement member.

18. The toner cartridge of claim 17, wherein the alignment member projects from the side surface of the first engagement member away from the second engagement member.

19. The toner cartridge of claim 17, wherein the alignment member is aligned vertically with the first vertical front surface.

20. A toner cartridge for use with a developer unit of an image forming device, comprising:

a housing having a front, a rear, a top, a bottom and a pair of sides, the housing having a reservoir for holding toner;

an outlet port on the front of the housing and facing toward the bottom of the housing for transferring toner from the reservoir to the developer unit through an inlet port on the developer unit, the outlet port being positioned on the front of the housing nearer a first side of the pair of sides; and a ramped engagement member projecting from the front of the housing, the ramped engagement member being spaced toward the bottom of the housing from the outlet port and spaced toward a second side of the pair of sides from the outlet port, the ramped engagement member having a front surface that projects further forward away from the front of the housing as said front surface travels up the front of the housing.

* * * * *